US005598926A

United States Patent [19]

Vogt

[11] Patent Number: 5,598,926

[45] Date of Patent: Feb. 4, 1997

[54] DECORATIVE PAGER ORNAMENT COVER

[76] Inventor: Kathleen D. Vogt, 11415 Longview Dr., Hagerstown, Md. 21740

[21] Appl. No.: 491,549

[22] Filed: Jun. 16, 1995

[51] Int. Cl.[6] ..... A45F 5/00

[52] U.S. Cl. ..... 206/457; 206/37; 206/38; 24/3.9; 224/587; D3/215; D3/218

[58] Field of Search ..... 206/457, 37, 38, 206/305; 24/3.1, 3.7, 3.9, 3.11, 3.12; 224/252; D3/215, 218, 219, 224, 226; 150/103, 104, 105

[56] References Cited

U.S. PATENT DOCUMENTS

| | | | |
|---|---|---|---|
| D. 163,394 | 5/1951 | Krasnow | 224/911 |
| D. 280,863 | 10/1985 | Leath . | |
| D. 329,749 | 9/1992 | Scheid | D3/218 |
| D. 329,750 | 9/1992 | Gilmore et al. | D3/218 |
| D. 329,945 | 10/1992 | Benskin | D3/218 |
| D. 348,475 | 7/1994 | Kahari | D3/226 X |
| 982,298 | 1/1911 | Pollock | 24/3.12 X |
| 3,556,187 | 1/1971 | Speakes | 150/105 |
| 3,561,066 | 2/1971 | Osteen | 24/3.12 |
| 3,777,953 | 12/1973 | Lewis | D3/226 X |
| 4,049,165 | 9/1977 | Goldhaft | 24/3.7 X |
| 4,901,852 | 2/1990 | King | 206/320 |
| 4,951,817 | 8/1990 | Barletta et al. | 206/305 |
| 5,186,326 | 2/1993 | Peckels et al. | 206/234 |
| 5,379,490 | 1/1995 | Wandt et al. | 24/3.11 |

FOREIGN PATENT DOCUMENTS

| | | | |
|---|---|---|---|
| 0655166 | 4/1929 | France | 150/105 |

*Primary Examiner*—Paul T. Sewell
*Assistant Examiner*—Tara Laster

[57] ABSTRACT

A decorative pager ornament cover for concealing a pager behind a decorative facia securable to an article of clothing. The inventive device includes a housing forming a portion of or receiving a pager. A securing assembly is secured to a rear surface of the housing for coupling to an article of clothing. A decorative facia is coupled to a front surface of the housing for concealing the pager and ornamentally accenting the wearer's article of clothing.

2 Claims, 4 Drawing Sheets

DECORATIVE PAGER ORNAMENT COVER

BACKGROUND OF THE INVENTION

1. Field of the Invention

The present invention relates to pager mounting structures and more particularly pertains to a decorative pager ornament cover for concealing a pager behind a decorative facia securable to an article of clothing.

2. Description of the Prior Art

The use of pager mounting structures is known in the prior art. More specifically, pager mounting structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art pager mounting structures include U.S. Pat. Nos. 4,951,817; 4,901,852; U.S. Design Pat. Nos. 280,863; 329,945; and 329,750.

While these devices fulfill their respective, particular objectives and requirements, the aforementioned patents do not disclose a decorative pager ornament cover for concealing a pager behind a decorative facia securable to an article of clothing which includes a housing forming a portion of or receiving a pager, a securing assembly secured to a rear surface of the housing for coupling to an article of clothing, and a decorative facia coupled to a front surface of the housing for concealing the pager and ornamentally accenting the wearer's article of clothing.

In these respects, the decorative pager ornament cover according to the present invention substantially departs from the conventional concepts and designs of the prior art, and in so doing provides an apparatus primarily developed for the purpose of concealing a pager behind a decorative facia securable to an article of clothing.

SUMMARY OF THE INVENTION

In view of the foregoing disadvantages inherent in the known types of pager mounting structures now present in the prior art, the present invention provides a new decorative pager ornament cover construction wherein the same can be utilized for concealing a pager behind a decorative facia. As such, the general purpose of the present invention, which will be described subsequently in greater detail, is to provide a new decorative pager ornament cover apparatus and method which has many of the advantages of the pager mounting structures mentioned heretofore and many novel features that result in a decorative pager ornament cover which is not anticipated, rendered obvious, suggested, or even implied by any of the prior art pager mounting structures, either alone or in any combination thereof.

To attain this, the present invention generally comprises a decorative pager ornament cover for concealing a pager behind a decorative facia securable to an article of clothing. The inventive device includes a housing forming a portion of or receiving a pager. A securing assembly is secured to a rear surface of the housing for coupling to an article of clothing. A decorative facia is coupled to a front surface of the housing for concealing the pager and ornamentally accenting the wearer's article of clothing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any It is therefore an object of the present invention to provide a new decorative pager ornament cover apparatus and method which has many of the advantages of the pager mounting structures mentioned heretofore and many novel features that result in a decorative pager ornament cover which is not anticipated, rendered obvious, suggested, or even implied by any of the prior art pager mounting structures, either alone or in any combination thereof.

It is another object of the present invention to provide a new decorative pager ornament cover which may be easily and efficiently manufactured and marketed.

It is a further object of the present invention to provide a new decorative pager ornament cover which is of a durable and reliable construction.

An even further object of the present invention is to provide a new decorative pager ornament cover which is susceptible of a low cost of manufacture with regard to both materials and labor, and which accordingly is then susceptible of low prices of sale to the consuming public, thereby making such decorative pager ornament covers economically available to the buying public.

Still yet another object of the present invention is to provide a new decorative pager ornament cover which provides in the apparatuses and methods of the prior art some of the advantages thereof, while simultaneously overcoming some of the disadvantages normally associated therewith.

Still another object of the present invention is to provide a new decorative pager ornament cover for concealing a pager behind a decorative facia securable to an article of clothing.

Yet another object of the present invention is to provide a new decorative pager ornament cover which includes a housing forming a portion of or receiving a pager, a securing assembly secured to a rear surface of the housing for coupling to an article of clothing, and a decorative facia coupled to a front surface of the housing for concealing the pager and ornamentally accenting the wearer's article of clothing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
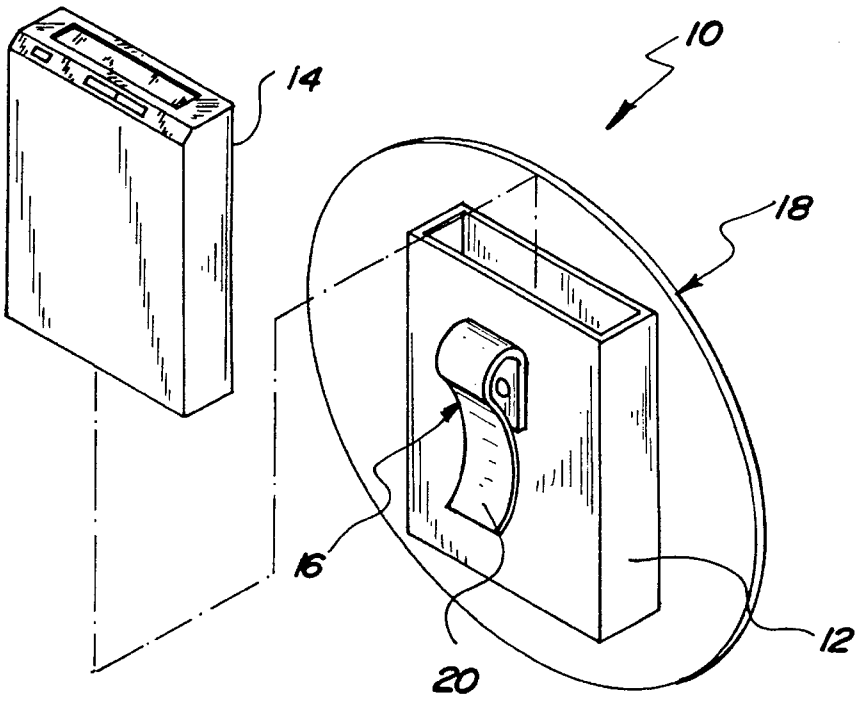
FIG. 2 is an exploded rear isometric illustration of the present invention detailing a securing means of the invention.

With reference now to the drawings, and in particular to FIGS. 1–10 thereof, a new decorative pager ornament cover embodying the principles and concepts of the present invention and generally designated by the reference numeral 10 will be described.

More specifically, it will be noted that the decorative pager ornament cover 10 comprises a housing 12 of substantially rectangular configuration which receive a pager 14 of conventionally know construction therewithin. Alternatively, the housing can be an integral part of the pager 14 if so desired. A securing means 16 is mounted to a rear face of the housing for securing the device 10 to an object or article of clothing. A decorative facia 18 is secured to a front face of the housing 12 for concealing the housing and decoratively accenting the wearer's article of clothing. By this structure, the decorative pager ornament cover 10 can be utilized to effect mounting and concealing of a pager 14 along an exterior of an article of clothing or other object, as illustrated in FIG. 1 of the drawings.

Figure 4:
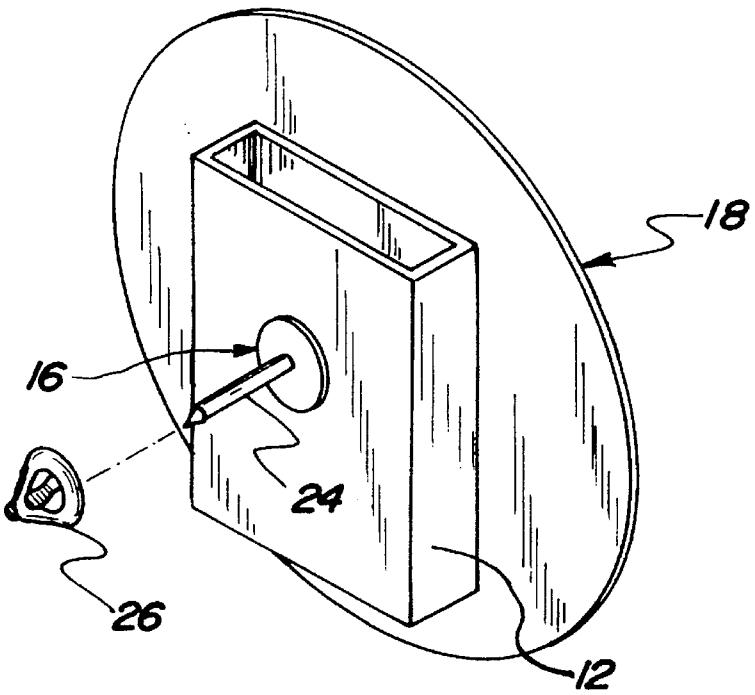
FIG. 4 is a rear isometric view of the invention including a third form of the securing means.
Figure 3:
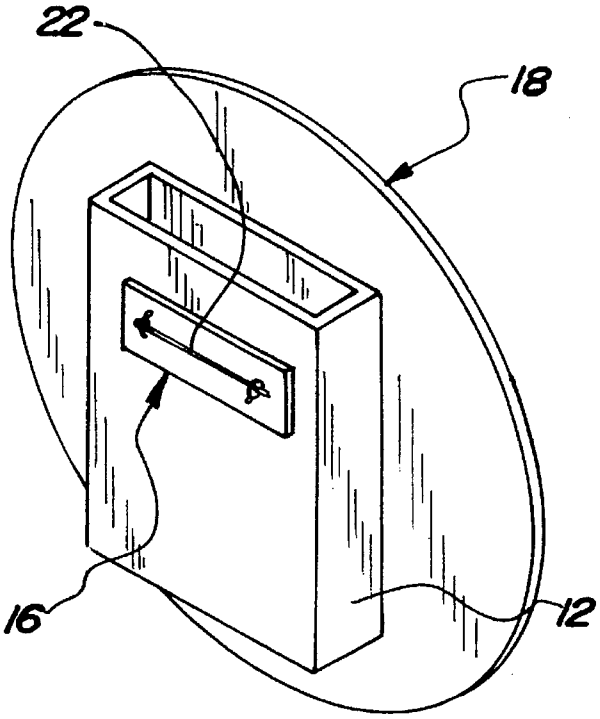
FIG. 3 is a rear isometric view of the invention including a second form of the securing means.

As shown in FIG. 2, the securing means 16 of the present invention 10 can comprise a belt clip 20 secured to the rear face of the housing 12 for frictionally capturing an object or portion of an article of clothing therebetween. Alternatively and as illustrated in FIG. 3, the securing means 16 can comprise a safety-pin clip 22 secured to the rear face of the housing for piercingly engaging an article of clothing. Further, the securing means, as shown in FIG. 4, can comprise an elongated pin 24 projecting substantially orthogonally from the rear face of the housing, and a removable clasp 26 of conventionally know construction securable to the pin so as to capture an article of clothing pierced by the pin between the housing and the clasp. Lastly, the securing means 16 may further alternatively comprise a tether or necklace 28 secured to the rear surface of the housing 12 which can be positioned over or about a neck or limb of a wearer. By these various configurations of the securing means 16, the present invention 10 can be easily secured in a desired manner so as to be supported relative to an object or article of clothing.

Figure 6:
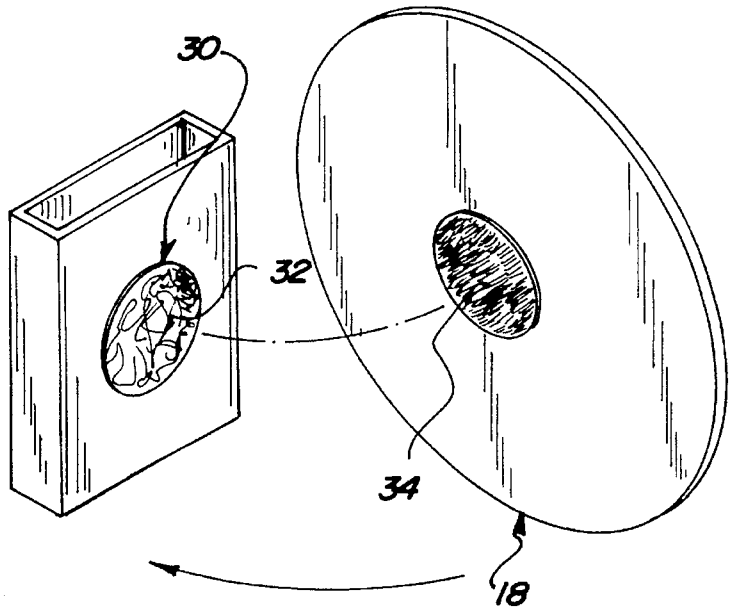
FIG. 6 is an exploded isometric illustration detailing a removable coupling means of the invention.
Figure 5:
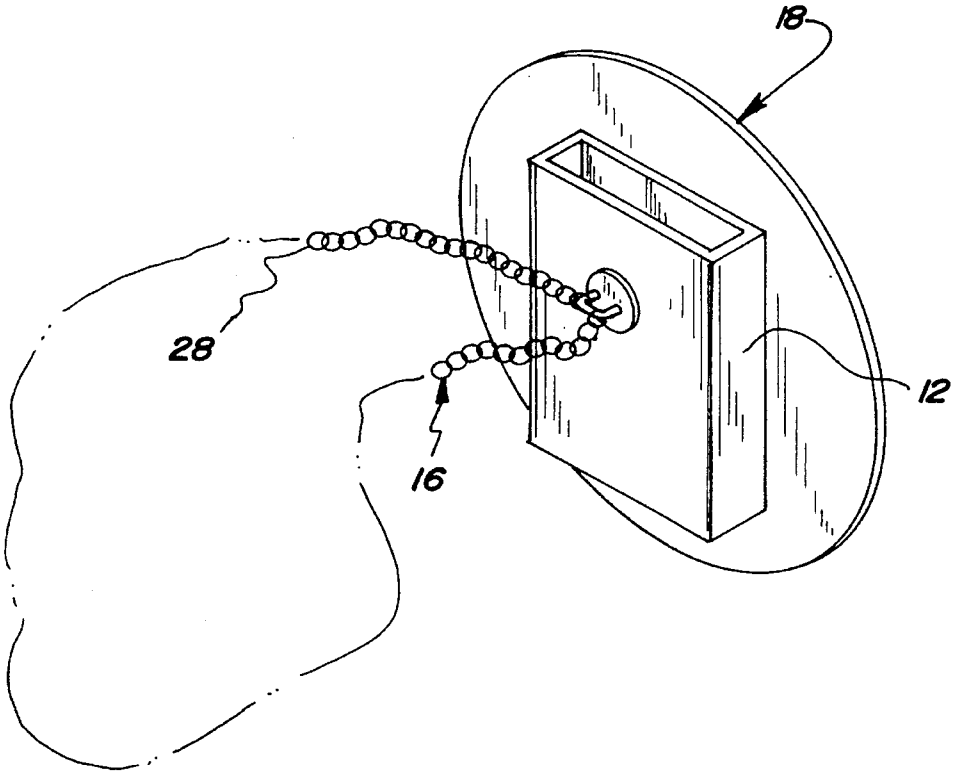
FIG. 5 is a rear isometric view of the invention including a fourth form of a securing means.
Figure 7:
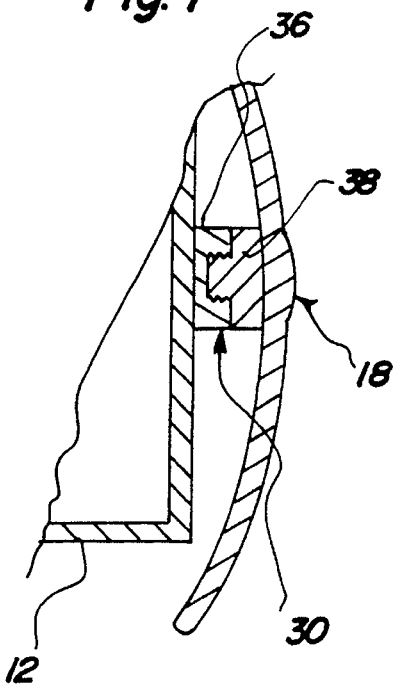
FIG. 7 is a cross sectional view of a second form of the removable coupling means.
Figure 8:
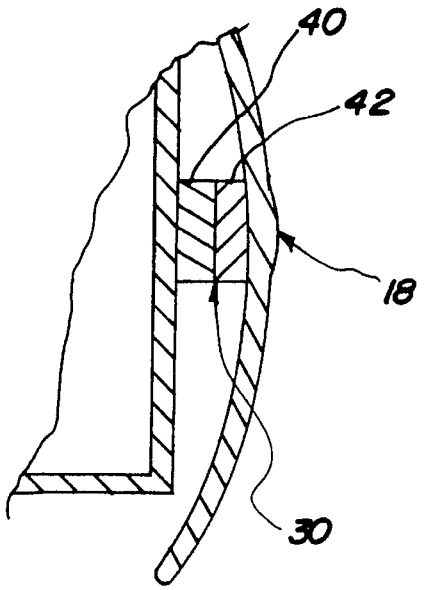
FIG. 8 is a cross sectional view of a third form of the removable coupling means.

Referring now to FIGS. 6 through 8, it can be shown that the present invention preferably comprises a removable coupling means 30 for removably coupling the decorative facia 18 to the front face of the housing 12. To this end and as shown in FIG. 6, the removable coupling means 30 can comprise a first portion 32 of fabric fastening material, such as is commonly known as the trademarked "VELCRO", secured to the front face of the housing 12. A second portion 34 of fabric fastening material is secured to a rear face of the decorative facia 18 to permit removable coupling of the facia relative to the housing. Alternatively and as shown in FIG. 7, the removable coupling means 30 may comprise a receiving boss 36 having an interiorly threaded bore directed thereinto secured to the front face of the housing 12. A mounting boss 38 having an exteriorly threaded projection which threadably engages the interiorly threaded bore of the receiving boss is mounted to a rear face of the decorative facia 18 so as to removably couple the facia to the housing. Referring to FIG. 8, the removable coupling means 30 may further alternatively comprise a first plate 40 secured to the front face of the housing 12, with a second plate 42 being secured to the rear surface of the decorative facia 18. Either or both of the first and second plates 40 and 42 can be comprised of a magnetic material, with the non-magnetic plate 40 or 42 being comprised of a substantially ferrous material to which the magnetic plate 40 or 42 is attracted so as to removably couple the decorative facia 18 to the front face of the housing 12. By this structure, the decorative facia 18 can be interchanged with other similarly constructed decorative facias to permit interchanging of an exterior appearance of the device 10 as desired by an end user.

Figure 1:
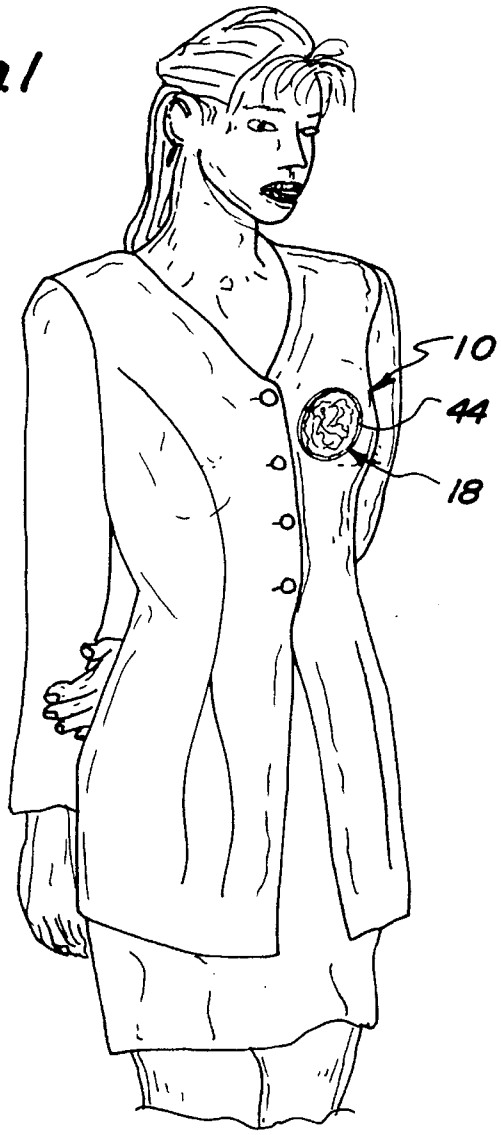
FIG. 1 is a front elevation view of a decorative pager ornament cover according to the present invention in use.
Figure 9:
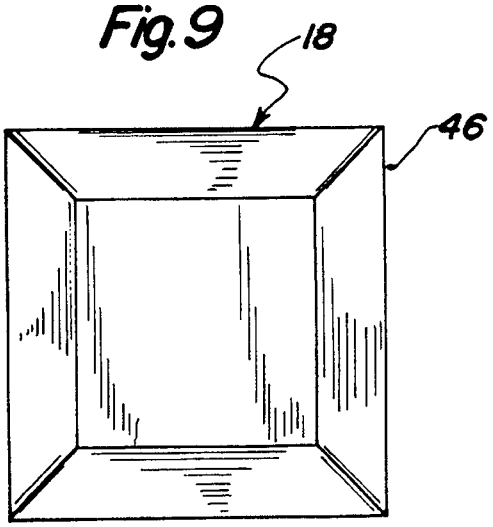
FIG. 9 is a front elevation view of a second form of a decorative facia of the invention.
Figure 10:
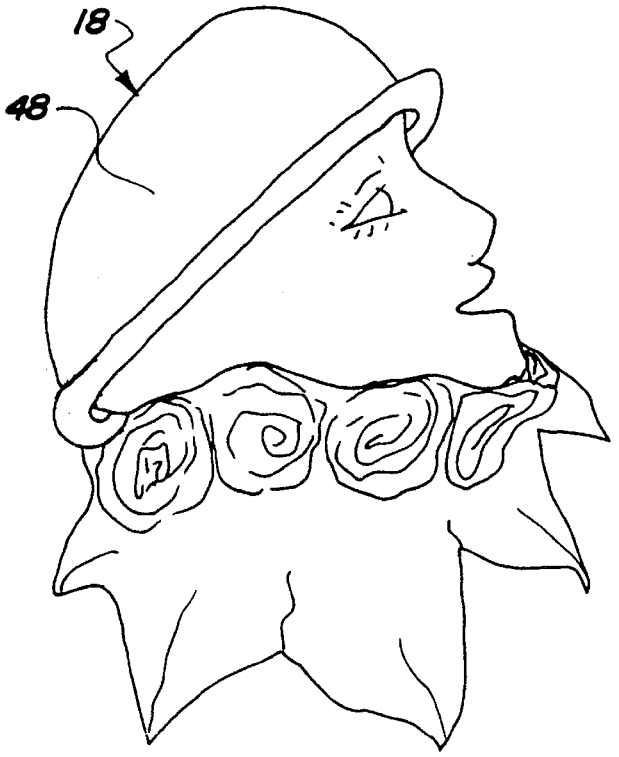
FIG. 10 is a front elevation view of a third form of the decorative facia.

Referring to FIGS. 9 and 10 with concurrent reference to FIG. 1, it can be shown that the decorative facia 18 may comprise a circular ornament 44 having an arcuate or domed exterior surface providing an ornamental appearance to the device 10. Alternatively and as shown in FIG. 9, the decorative facia 18 may comprise a square or polygonal ornament 46. A simulated ornament 48, as shown in FIG. 10, can fulfill the structural requirements of the decorative facia 18 to provide a desired appearance to the device 10 when coupled to the housing 12.

In use, the decorative pager ornament cover 10 according to the present invention can be easily utilized to conceal and support a pager 14 relative to an object or a wearer's clothing. The present invention 10 substantially reduces or eliminates a typical problem of attaching a pager to the various configurations of women's clothing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A decorative ornament cover and pager comprising:

a housing;

a securing means mounted to a rear face of the housing for securing the housing to an object;

a decorative facia, said decorative facia having a front face and a rear face, said decorative facia having its rear face secured to a front face of the housing for concealing the housing, and further comprising:

a pager insertable within the housing, a removable coupling means for removably coupling the decorative facia to the front face of the housing, wherein the removable coupling means comprises a first portion of fabric fastening material secured to the front face of the housing; and a second portion of fabric fastening material secured to a rear face of the decorative facia, with the portions of fabric fastening material being engaged together, wherein said housing comprises a first side wall defining said front face of said housing, a second side wall defining said rear face of said housing, a first end wall, a second end wall, and a bottom wall;

wherein said first and second side Walls, said first and second end walls, and said bottom wall are configured to form said housing such that said housing has an opening opposite said bottom wall and extending between said first and second side walls and between said first and second end walls whereby said pager is adapted to be insertable through said opening and into said housing for removable placement therein;

said decorative facia extending beyond said first side wall, said bottom wall and said opening to conceal said housing and said pager insertable therein when said decorative facia is viewed from a position remote with respect to said front face of said decorative facia.

2. The decorative pager ornament cover of claim 1, wherein the securing means comprises a belt clip secured to the rear face of the housing for frictionally capturing an object.

* * * * *